United States Patent [19]

Swihart

[11] Patent Number: 4,731,191

[45] Date of Patent: Mar. 15, 1988

[54] METHOD FOR PROTECTING CARBONYL IRON POWDER AND COMPOSITIONS THEREFROM

[75] Inventor: Terence J. Swihart, Essexville, Mich.

[73] Assignee: Dow Corning Corporation, Midland, Mich.

[21] Appl. No.: 815,417

[22] Filed: Dec. 31, 1985

[51] Int. Cl.[4] ..... H01F 1/26

[52] U.S. Cl. ..... 252/62.54; 252/62.55; 427/216; 427/221

[58] Field of Search ..... 428/405; 427/216, 127, 427/221, 128; 252/62.54, 62.55

[56] References Cited

U.S. PATENT DOCUMENTS

| | | | |
|---|---|---|---|
| 3,628,986 | 12/1971 | Segura et al. | 428/405 |
| 4,310,678 | 1/1982 | Blizzard et al. | 556/451 |
| 4,322,518 | 3/1982 | Blizzard | 528/15 |
| 4,475,946 | 10/1984 | Matsufuji et al. | 428/405 |
| 4,530,894 | 7/1985 | Imamura et al. | 428/405 X |
| 4,537,829 | 8/1985 | Blizzard et al. | 428/429 |
| 4,601,753 | 7/1986 | Soileau et al. | 427/216 X |

FOREIGN PATENT DOCUMENTS

| | | | |
|---|---|---|---|
| 59-107504 | 6/1984 | Japan | 428/405 |
| 7012276 | 2/1972 | Netherlands | 427/216 |

OTHER PUBLICATIONS

"Curable Silicone Compositions Comprising SiH-Containing Resin and Anti-Hydrogen Additive;" J. D. Blizzard.

*Primary Examiner*—Evan K. Lawrence
*Attorney, Agent, or Firm*—George A. Grindahl

[57] ABSTRACT

Carbonyl iron powder (CIP) can be protected from extensive atmospheric oxidation by mixing and heating it with a silicon compound having one or more reactive groups. The resulting CIP is more readily accepted by a silicone binder when preparing mixtures thereof.

9 Claims, No Drawings

METHOD FOR PROTECTING CARBONYL IRON POWDER AND COMPOSITIONS THEREFROM

BACKGROUND OF THE INVENTION

The present invention relates to carbonyl iron powder, herein also referred to as CIP for convenience. More specifically, this invention relates to a method for protecting CIP from extensive atmospheric oxidation and to compositions prepared with the protected CIP.

CIP is used as a component in the formation of cores in electronic devices such as tuned circuits, chokes and transformers. Typically, CIP is processed so that its individual particles are insulated and then intimately mixed with a binder and the magnetic core is thereafter molded from the mixture, using conventional molding methods. The resulting cores can be lightly machined and turned if necessary. Examples of suitable insulating materials include lacquers, shellacs, waterglass and phosphoric acid. Examples of suitable binders include thermosetting resins and thermoplastic resins. The volume fraction of iron in the core can be as high as 95%.

When CIP is mixed with a silicone binder it is not readily accepted by the binder. In addition the resulting composition undergoes oxidation in the presence of atmospheric moisture.

BRIEF SUMMARY OF THE INVENTION

It is an object of this invention to provide carbonyl iron powder-filled silicone compositions having improved resistance to oxidation in a moist atmosphere. It is another object of this invention to provide a method for protecting CIP against atmospheric oxidation. It is also an object of this invention to improve the acceptance of CIP in a silicone binder.

These objects, and others which will become apparent upon consideration of the following disclosure and appended claims, are obtained by the present invention which comprises heating and mixing CIP with a sufficient amount of a reactive silicon compound so that the CIP is coated with a protective silicon-containing coating. The resulting coated iron powder can then be mixed with a binder to provide iron-containing compositions which have improved resistance to atmospheric oxidation.

DETAILED DESCRIPTION OF THE INVENTION

The present invention relates to a method for increasing the usefulness of carbonyl iron powder as a component in a composition containing a binder, said method comprising heating and mixing the carbonyl iron powder with an amount of a silicon compound which contains one or more reactive silicon-bonded radicals, said amount being sufficient to reduce the atmospheric oxidation of the carbonyl iron powder.

The present invention also relates to a method for preparing a composition containing carbonyl iron powder and a silicone binder, said method comprising heating and mixing the carbonyl iron powder with an amount of a silicon compound which contains one or more reactive silicon-bonded radicals, said amount being sufficient to reduce the atmospheric oxidation of the carbonyl iron powder, and then mixing the resulting carbonyl iron powder with the binder.

The present invention also relates to a method for improving the oxidation resistance of carbonyl iron powder in the presence of wet air at ambient conditions, said method comprising heating and mixing the carbonyl iron powder with an effective amount of a silicon compound which contains one or more reactive silicon-bonded radicals.

The basic carbonyl iron powder (CIP) used in this invention has been prepared by thermally decomposing purified iron pentacarbonyl in the vapor state to deposit iron particles in the form of discrete spheres ranging in size from 1 to 10 micrometers in diameter and containing small amounts of carbon and nitrogen. The resulting basic CIP typically has an ammonia component which can be detected by sampling the gas phase above basic CIP that has been stored in a closed container.

The CIP used in the process of this invention can also be the CIP that has been purified by the process of Fey, disclosed in an application titled "Method for Treating Carbonyl Iron Powder and Compositions Therefrom", filed on even date herewith and assigned to the assignee of this invention.

Carbonyl iron powder is commercially available in various sieve sizes, hardnesses and purities.

In the method of this invention CIP is mixed with a silicon compound that will react to provide a silicon-containing coating on the surface of the CIP. It is not clear at this time whether the silicon compound reacts with the CIP, with itself or in some other manner that results in the silicon-containing coating on the CIP. However, the silicon-containing compound has one or more silicon-bonded radicals that are reactive.

Examples of suitable silicon-bonded reactive radicals for the method of this invention include hydrogen, hydroxyl, alkoxy such as methoxy and ethoxy, and other radicals which provide neutral compounds when removed from silicon by hydrolysis. Two or more types of these reactive radicals can also be present in the silicon compound.

While the full range of silicon compounds that might work in the method of this invention has not been investigated it has been determined that the silicon compound can be be a silane or a siloxane.

Examples of silanes which are suitable for use in the method of this invention include alkoxysilanes having from one to four, but preferably three, alkoxy radicals per silicon, any other radicals in the silane being selected from the group consisting of hydrogen and hydrocarbon radicals, such as alkyl, alkenyl, aryl, aralkyl, alkaryl and cycloaliphatic. Specific examples of suitable silanes include methyltrimethoxysilane, phenyltrimethoxysilane, vinyltrimethoxysilane, tributoxysilane, dimethyldimethoxysilane, phenylmethyldimethoxysilane, trimethylmethoxysilane, methyldimethoxysilane and ethyl orthosilicate.

Examples of siloxanes which are suitable for use in the method of this invention include linear, branched and cyclic polyhydrocarbylsiloxanes wherein the hydrocarbon radicals are as noted above for the suitable silanes. Specific examples thereof include polydimethylsiloxanes bearing one or more, but preferably three or more, hydroxyl and/or alkoxyl radicals, typically as terminal radicals, and said polydimethylsiloxanes wherein some of the methyl radicals have been replaced with phenyl and/or vinyl radicals.

A particularly useful siloxane for the method of this invention is a liquid copolymeric organopolysiloxane. Herein the term liquid copolymeric organopolysiloxane means an organopolysiloxane which contains $SiO_{4/2}$ siloxane units, sites wherein a hydrogen atom is bonded directly to a silicon atom and sites wherein a hydroxyl radical is directly bonded to a silicon atom. The liquid copolymeric organopolysiloxane is therefore a multireactive organopolysiloxane, having available therein silicon hydride atoms, possibly for eventual reaction with silanol radicals and/or aliphatically unsaturated materials, and silanol radicals available therein, possibly for eventual reaction with silicon hydride atoms and/or other silanol radicals, if desired.

The method of this invention comprises the use of any liquid copolymeric organopolysiloxane; however, the liquid copolymeric organopolysiloxane compositions disclosed by Blizzard and Swihart in U.S. Pat. No. 4,310,678 have been shown to be particularly effective for protecting CIP. The disclosure of said patent is incorporated herein by reference to delineate said liquid copolymeric organopolysiloxane compositions and to teach how to prepare same.

Briefly, the liquid copolymeric organopolysiloxane compositions of Blizzard and Swihart are prepared by (A) forming an acidic homogeneous mixture comprising (a) an organic solvent solution of a resinous copolymeric siloxane containing silicon-bonded hydroxyl radicals and consisting essentially of $R_3SiO_{\frac{1}{2}}$ siloxane units and $SiO_{4/2}$ siloxane units wherein the ratio of the former to the latter, on a molar basis, has a value of from 0.6/1 to 0.9/1 and each R denotes, independently, a monovalent hydrocarbon radical; and (b) a liquid organohydrogenpolysiloxane wherein each organic radical is, independently, a monovalent hydrocarbon radical, there being an average of at least one silicon-bonded hydrogen atom per molecule of said organohydrogenpolysiloxane; and, (B) heating the homogenous mixture to remove substantially all of the organic solvent therefrom. While the R radicals, and other organic radicals that are present in the siloxane reactants, can be any monovalent hydrocarbon radical, such as methyl, vinyl and phenyl, the liquid copolymeric organopolysiloxane is preferably prepared from methyl-containing resinous copolymeric siloxanes and methylhydrogenpolysiloxanes.

In particular, a liquid copolymeric organopolysiloxane composition that has been prepared by (A) forming an acidic homogeneous mixture comprising (a) an organic solvent solution of from 40 to 60, preferably 50, parts by weight of a resinous copolymeric siloxane containing silicon-bonded hydroxyl radicals and consisting essentially of $(CH_3)_3SiO_{\frac{1}{2}}$ siloxane units and $SiO_{4/2}$ siloxane units wherein the ratio of the former to the latter, on a molar basis, has a value of from 0.6/1 to 0.9/1, and (b) 40 to 60, preferably 50, parts by weight of a methylhydrogenpolysiloxane having the formula $Me_3SiO(Me_2SiO)_xSiMe_3$ wherein Me denotes the methyl radical and x has a value of from 35 to 70; and (B) heating the homogenous mixture to remove substantially all of the organic solvent therefrom is a particularly useful liquid copolymeric organopolysiloxane from the aspect of convenient mixing viscosity and reactivity with other organopolysiloxane compositions.

In the method of this invention the CIP is mixed with the silicon compound using any mixing means that are commonly used in the organosiloxane polymer art, such as impeller mixers, sigma blade mixers and two- or three-roll mills. It is preferred that the silicon compound be mixed into the CIP rather than the reverse, although this is not necessary. Solvents, such as toluene, xylene or hexane, can be used to facilitate this mixing, if desired.

The mixture of CIP and silicon compound is heated sufficiently to provide a CIP that has a reduced tendency to oxidize in a moist atmosphere at ambient conditions. While the full range of heating conditions has not been investigated it has been found that heating CIP in the presence of a silicon compound at 150° C. will provide a CIP suitably protected from the ambient atmosphere.

While a heating temperature of 150° C. has been found to be a suitable temperature for practicing the present method, lesser or greater temperatures can also be used, provided an inert atmosphere is used at temperatures greater than about 150° C. Preferably the CIP is not heated to the caking point.

The CIP and the silicon compound can be mixed in any desired weight ratio; however, I have found that excellent results can be obtained when the CIP is treated with about 4 percent by weight, based on the weight of the CIP, of the silicon compound, particularly when the silicon compound is a liquid copolymeric organopolysiloxane. Consequently to use more than 10% or less than 1% of the silicon compound would be less effective from the aspect of economics or performance, respectively.

The CIP that has been treated by the method of this invention has an increased resistance to oxidation in the presence of a moist atmosphere. Said CIP also has an improved compatibility with a silicone binder, as determined by the increased ease with which the CIP can be incorporated into the binder. Accordingly, the present invention relates not only to a method for protecting CIP and to the CIP resulting therefrom, it also relates to an improved method for preparing compositions comprising CIP and a silicone binder.

The silicone binder referred to herein can be any of the well-known curable silicone compositions that find utility as coating compositions. These curable silicone compositions typically comprise a polydiorganosiloxane bearing curing radicals, such as hydroxyl, alkoxy, vinyl and the like. Said compositions further comprise a curing agent to improve and/or accelerate the curing reaction of the polydiorganosiloxane. Examples of typical curing agents include catalysts such as peroxide compounds, tin compounds and platinum compounds, crosslinking agents such as silanes and siloxanes bearing silicon-bonded hydrogen atoms or alkoxy radicals and mixtures of catalysts and crosslinking agents.

For compositions which comprise a large amount, for example 75 to 95% by weight, of CIP the silicone binder is preferably a silicone composition which comprises a liquid copolymeric organopolysiloxane, such as that delineated above for the treatment of CIP by the method of this invention.

Among many such silicone compositions are those disclosed in U.S. Pat. Nos. 4,322,518 and 4,537,829 and in Blizzard's application titled "Curable Silicone Compositions Comprising SiH-Containing Resin and Anti-Hydrogen Additive", filed on even date herewith and assigned to the assignee of this invention. The disclosures of Blizzard's application and the disclosures of U.S. Pat. Nos. 4,322,518 and 4,537,829 are incorporated herein by reference to teach some preferred silicone binders of the art.

The silicone binder can further comprise optional components such as fillers, volatile and non-volatile diluents such as hydrocarbon solvents, low molecular weight siloxanes and high molecular weight siloxanes, vinyl- and/or silanol-functional polydiorganosiloxanes and reactivity modifiers.

The following examples are disclosed to further illustrate, but not limit, the present invention which is properly delineated by the appended claims.

Parts and percentages are by weight, unless otherwise stated. Viscosity was measured at 25° C. using a Brookfield rotating spindle viscometer.

The siloxanes referred to in the examples are:

SILOXANE A-A liquid copolymeric organopolysiloxane prepared according to the method of U.S. Pat. No. 4,310,678 as follows. A mixture of (i) 41.2 parts of an organosilicon resin composed of $Me_3SiO_{\frac{1}{2}}$ units and $SiO_{4/2}$ units in the ratio of 0.6 $Me_3SiO_{\frac{1}{2}}$ unit to 1 $SiO_{4/2}$ unit; (ii) 41.2 parts of a polymer having the average formula $Me_3SiO(MeHSiO)_{35}SiMe_3$; and 17.6 parts of xylene was charged to a vessel provided with a stirrer. This mixture, with continuous stirring, was heated to a temperature of 150° C. The pressure in the vessel was gradually reduced to a value between 40 mm and 50 mm Hg. Heating under reduced pressure was continued for approximately 2 hours. During this time, volatilized xylene was removed and condensed in a reservoir separate from the vessel containing the mixture. After 2 hours, the reaction product was recovered as a substantially solvent-free, liquid, organosilicon resin.

SILOXANE B-A mixture of 100 parts of a vinyl-terminated polydimethylsiloxane having a viscosity of approximately 35,000 centipoise and 750 dimethylsiloxy units per molecule and 40 parts of a silicone resin composed of $Me_2ViSiO_{\frac{1}{2}}$ units, $Me_3SiO_{\frac{1}{2}}$ units and $SiO_{4/2}$ units in the ratio 0.15:0.6:1 prepared according to the method of U.S. Pat. No. 2,676,182.

SILOXANE C-A mixture of 32 parts of a hydroxyl-terminated polydimethylsiloxane gum having a number average molecular weight of approximately 250,000 and 68 parts of toluene.

SILOXANE D-A mixture of 98 parts of Siloxane A, 1.5 parts of methylbutynol and 0.5 part of polymethylvinylcyclosiloxane.

EXAMPLE 1

A 100-gram portion of basic carbonyl iron powder (Grade E from United Mineral & Chemical Corp., New York, N.Y.) having a nominal purity of 98% Fe, 0.8% C, 0.8% N and 0.3% O and a pH of 8.3 was mixed with 4 grams of methyltrimethoxysilane and the mixture was heated for 30 minutes at 300° F. to treat the powder. A 10.0157-gram portion of the treated powder and a 10.2165-gram portion of the untreated basic carbonyl iron powder were placed in a humidity chamber at 95% relative humidity and 160° F. for 7 days. The samples were then removed from the chamber, dried at 300° F. for 30 minutes and weighed to determine weight increase. The iron treated by the method of this invention was lumpy with dark spots and had a weight gain of 22% while the untreated iron was a hard mass and had gained 74%.

EXAMPLE 2

A composition of this invention was prepared by mixing 7.5 parts of Siloxane D, 17.5 parts of Siloxane B, 0.25 part of a platinum-containing catalyst and 100 parts of the carbonyl iron powder of Example 1. A second composition was identically prepared except 100 parts of untreated carbonyl iron powder was used instead of the 100 parts of treated carbonyl iron powder. The compositions were heated at 280° F. for 15 minutes to accelerate cures thereof. These compositions cured to tough, flexible materials.

EXAMPLE 3

A curable composition was prepared by mixing 105 parts of Siloxane B, 45.0 parts of Siloxane D and 1.5 parts of a platinum-containing catalyst. A composition of this invention was prepared by mixing 24 parts of this curable composition with 96 parts of the treated carbonyl iron powder of Example 1. Both compositions were press-molded at 280° F. for 10 minutes and the cured materials were tested for tensile strength, percent elongation at break and durometer. The cured materials were also exposed to 95% relative humidity at 160° F. for 7 days and then identically tested. The cured composition of this invention had values for durometer/tensile strength/elongation of 93/843 psi/95%, as molded, and values of 99/547 psi/65% after the humidity exposure. The cured composition having no iron had values for durometer/tensile strength/elongation of 85/940 psi/105%, as molded, and values of 91/951 psi/125% after the humidity exposure.

EXAMPLE 4

A composition of this invention was prepared by mixing 100 parts of the treated carbonyl iron powder of Example 1, 53 parts of Siloxane C, 8 parts of Siloxane D and 0.6 part of a platinum-containing catalyst. This composition was press-molded and the resulting elastomeric sheet had values of 80/453 psi/255% for durometer/tensile strength/elongation. After being exposed to 95% relative humidity at 160° F. for 7 hours the elastomeric sheet had values of 83/388 psi/185%.

EXAMPLE 5

A composition of this invention was prepared by mixing 62 parts of the treated carbonyl iron powder of Example 1, 26.6 parts of Siloxane C, 4 parts of Siloxane D and 0.3 part of a platinum-containing catalyst. Another composition was identically prepared except that untreated carbonyl iron powder was used instead of the treated carbonyl iron powder and it was mixed with Siloxane D and the resulting mixture was then mixed with the other components of the composition. When cured at room temperature for 60 minutes and post cured at 150° C. for 5 minutes both compositions cured to strong, flexible materials; however, the treated carbonyl iron powder was accepted by the siloxanes better than the untreated carbonyl iron powder.

EXAMPLE 6

A 150-gram portion of basic carbonyl iron powder (Grade E from United Mineral & Chemical Corp., New York, N.Y.) having a nominal purity of 98% Fe, 0.8% C, 0.8% N and 0.3% O and a pH of 8.3 was mixed with 6 grams of Siloxane D and 2 grams of toluene and the mixture was heated for 30 minutes at 300° F. to treat the powder. A 10.2275-gram portion of the treated powder and a 10.2165-gram portion of the untreated basic carbonyl iron powder were placed in a humidity chamber at 95% relative humidity and 160° F. for 7 days. The samples were then removed from the chamber, dried at 300° F. for 30 minutes and weighed to determine weight increase. The iron treated by the method of this invention was crusty and had no weight gain while the untreated iron was a hard mass and had gained 74%.

That which is claimed is:

1. A method for preparing a composition containing carbonyl iron powder and a silicone binder, said method comprising heating and mixing the carbonyl iron powder with an amount of a silicon compound which contains one or more reactive silicon-bonded radicals, said amount being sufficient to reduce the atmospheric oxidation of the carbonyl iron powder, and then mixing the resulting carbonyl iron powder with the binder.

2. A method according to claim 1 wherein the silicon compound is a liquid copolymeric organopolysiloxane containing $SiO_{4/2}$ siloxane units, SiH sites and SiOH sites which has been prepared by (A) forming an acidic homogeneous mixture comprising (a) an organic solvent solution of a resinous copolymeric siloxane containing silicon-bonded hydroxyl radicals and consisting essentially of $R_3SiO_{\frac{1}{2}}$ siloxane units and $SiO_{4/2}$ siloxane units wherein the ratio of the former to the latter, on a molar basis, has a value of from 0.6/1 to 0.9/1 and each R denotes, independently, a monovalent hydrocarbon radical; and (b) a liquid organohydrogenpolysiloxane wherein each organic radical is, independently, a monovalent hydrocarbon radical, there being an average of at least one silicon-bonded hydrogen atom per molecule of said organohydrogenpolysiloxane; and, (B) heating the homogenous mixture to remove substantially all of the organic solvent therefrom.

3. A method according to claim 2 wherein the silicon compound is a liquid copolymeric organopolysiloxane containing $SiO_{4/2}$ siloxane units, SiH sites and SiOH sites which has been prepared by (A) forming an acidic homogeneous mixture comprising (a) an organic solvent solution of from 40 to 60 parts by weight of a resinous copolymeric siloxane containing silicon-bonded hydroxyl radicals and consisting essentially of $(CH_3)_3SiO_{\frac{1}{2}}$ siloxane units and $SiO_{4/2}$ siloxane units wherein the ratio of the former to the latter, on a molar basis, has a value of from 0.6/1 to 0.9/1, and (b) 40 to 60 parts by weight of a methylhydrogenpolysiloxane having the formula $Me_3SiO(Me_2SiO)_xSiMe_3$ wherein Me denotes the methyl radical and x has a value of from 35 to 70; and (B) heating the homogenous mixture to remove substantially all of the organic solvent therefrom.

4. A method according to claim 1 wherein the silicon compound is an alkoxysilane.

5. A method according to claim 4 wherein the alkoxysilane is methyltrimethoxysilane.

6. A method according to claim 1 wherein the carbonyl iron powder is heated to a temperature of 150° C. in the presence of the silicon compound.

7. A method according to claim 1 wherein the binder is a silicone binder comprising a liquid copolymeric organopolysiloxane containing $SiO_{4/2}$ siloxane units, SiH sites and SiOH sites which has been prepared by (A) forming an acidic homogeneous mixture comprising (a) an organic solvent solution of a resinous copolymeric siloxane containing silicon-bonded hydroxyl radicals and consisting essentially of $R_3SiO_{\frac{1}{2}}$ siloxane units and $SiO_{4/2}$ siloxane units wherein the ratio of the former to the latter, on a molar basis, has a value of from 0.6/1 to 0.9/1 and each R denotes, independently, a monovalent hydrocarbon radical; and (b) a liquid organohydrogenpolysiloxane wherein each organic radical is, independently, a monovalent hydrocarbon radical, there being an average of at least one silicon-bonded hydrogen atom per molecule of said organohydrogenpolysiloxane; and, (B) heating the homogenous mixture to remove substantially all of the organic solvent therefrom.

8. A method according to claim 7 wherein the binder is a silicone binder comprising a liquid copolymeric organopolysiloxane containing $SiO_{4/2}$ siloxane units, SiH sites and SiOH sites which has been prepared by (A) forming an acidic homogeneous mixture comprising (a) an organic solvent solution of from 40 to 60 parts by weight of a resinous copolymeric siloxane containing silicon-bonded hydroxyl radicals and consisting essentially of $(CH_3)_3SiO_{\frac{1}{2}}$ siloxane units and $SiO_{4/2}$ siloxane units wherein the ratio of the former to the latter, on a molar basis, has a value of from 0.6/1 to 0.9/1, and (b) 40 to 60 parts by weight of a methylhydrogenpolysiloxane having the formula $Me_3SiO(Me_2SiO)_xSiMe_3$ wherein Me denotes the methyl radical and x has a value of from 35 to 70; and (B) heating the homogenous mixture to remove substantially all of the organic solvent therefrom.

9. The composition produced by the method of claim 1.

* * * * *